US006354295B1

(12) United States Patent
Hasson, Jr.

(10) Patent No.: US 6,354,295 B1
(45) Date of Patent: Mar. 12, 2002

(54) SUPPLIED AIR SNORKELING DEVICE

(75) Inventor: Wayne R. Hasson, Jr., Grand Cayman (KY)

(73) Assignee: Oceans for Youth Foundation, Parkville, MO (US)

( * ) Notice: Subject to any disclaimer, the term of this patent is extended or adjusted under 35 U.S.C. 154(b) by 0 days.

(21) Appl. No.: 09/226,905

(22) Filed: Jan. 8, 1999

(51) Int. Cl.[7] ..... A62B 7/00; A62B 9/00

(52) U.S. Cl. ..... 128/205.22; 128/201.27; 128/202.19; 2/2.15; 2/2.17; 405/186; 441/106; 441/108; 441/112; 441/115; 441/129

(58) Field of Search ..... 128/200.29, 201.11, 128/201.27, 202.13, 202.14, 202.19, 204.26, 205.22; 2/2.15–2.17; 441/106, 108, 112, 113, 115, 129; 405/186

(56) References Cited

U.S. PATENT DOCUMENTS

| | | | | | |
|---|---|---|---|---|---|
| 120,089 | A | | 10/1871 | Ormsbee | |
| 183,521 | A | | 10/1876 | Weck | |
| 616,439 | A | | 12/1898 | Shepherd | |
| 639,790 | A | | 12/1899 | Strattner | |
| 1,197,115 | A | | 9/1916 | Fell et al. | |
| 1,324,514 | A | | 12/1919 | Müller | |
| 1,878,474 | A | | 9/1932 | Dräger | |
| 2,385,816 | A | * | 10/1945 | Krupp | 2/10 |
| 2,780,224 | A | | 2/1957 | Wallace | |
| 2,864,101 | A | * | 12/1958 | Kissenberger | 441/186 |
| 2,931,057 | A | | 4/1960 | Vilarem | |
| 2,975,439 | A | | 3/1961 | Bentley | |
| 2,982,105 | A | * | 5/1961 | Akers | 441/186 |
| 3,135,098 | A | | 6/1964 | Root | |
| 3,246,350 | A | | 4/1966 | Pollmann | |
| 3,265,066 | A | | 8/1966 | Kathehis | |
| 3,536,071 | A | * | 10/1970 | Ferrando | 441/186 |
| 3,670,509 | A | * | 6/1972 | Walters | 61/69 |
| 3,747,139 | A | | 7/1973 | Braly | |
| 3,820,348 | A | | 6/1974 | Fast | |
| 4,015,300 | A | * | 4/1977 | Hayward et al. | 9/341 |
| 4,016,616 | A | | 4/1977 | Walters | |
| 4,054,132 | A | | 10/1977 | Deeds | |
| 4,137,585 | A | * | 2/1979 | Wright, III | 9/314 |
| 4,227,521 | A | | 10/1980 | Hart et al. | |
| 4,383,528 | A | | 5/1983 | Eppolito | |
| 4,438,764 | A | | 3/1984 | Eppolito 2 | |

(List continued on next page.)

FOREIGN PATENT DOCUMENTS

| | | |
|---|---|---|
| DE | 889565 | 9/1953 |

*Primary Examiner*—Aaron J. Lewis
*Assistant Examiner*—Joseph F. Weiss, Jr.
(74) *Attorney, Agent, or Firm*—Smith, Danamraj & Youst, P.C.

(57) ABSTRACT

A supplied air snorkeling device is provided. This device includes a flotation vest coupled with a tank holder. This flotation vest contains flotation material that cannot be deflated and substantially prohibits a user from submerging. A tank cover is positioned within the tank holder for holding an air tank. Still further, a hose retainer is coupled with the vest. In use, an air tank is placed within the tank cover which is then placed within the tank holder. A hose extends from the air tank through the hose retainer and is connected to a regulator that is connected to a mouthpiece which fits into a user's mouth. The hose retainer keeps the mouthpiece in close proximity to the user's mouth. Another aspect of the present invention is a method of making this supplied air snorkeling device. This method includes coupling a tank holder with a flotation vest. Still another aspect of the present invention is a method of snorkeling that includes securing this flotation vest coupled with a tank holder around a user and supplying contained air held by the tank holder to the user.

3 Claims, 3 Drawing Sheets

U.S. PATENT DOCUMENTS 4,623,316 A 11/1986 Ratliff
4,640,215 A 2/1987 Purifoy, Jr.
4,739,913 A 4/1988 Moore
4,752,263 A 6/1988 Pritchard et al.
4,779,554 A 10/1988 Courtney
4,791,921 A 12/1988 Robison
4,913,589 A * 4/1990 Faulconer et al. ..... 405/186
4,964,405 A 10/1990 Arnoth
5,020,941 A * 6/1991 Bulin et al. ..... 405/186
5,175,911 A * 1/1993 Terrels et al. ..... 24/674
5,259,372 A 11/1993 Gross et al.
5,346,419 A * 9/1994 Kaiser ..... 441/96
5,351,681 A 10/1994 Hudson
5,370,113 A 12/1994 Parsons
5,400,934 A 3/1995 Ducros
5,403,123 A * 4/1995 Walters ..... 405/286
5,476,055 A 12/1995 Hackett et al.
5,494,377 A * 2/1996 Garofalo ..... 405/186
5,516,233 A 5/1996 Courtney
5,529,061 A 6/1996 Sanders
5,535,734 A 7/1996 Lu et al.
5,588,891 A * 12/1996 Bardot ..... 441/115
5,606,967 A 3/1997 Wang
5,636,777 A * 6/1997 Semeia ..... 224/575
5,662,433 A 9/1997 Seligman
5,788,475 A * 8/1998 Henderson ..... 405/186
5,809,998 A * 9/1998 Hughes et al. ..... 128/204.17
5,887,585 A * 3/1999 Dusenbery ..... 128/202.14
5,902,073 A * 5/1999 Eungard et al. ..... 405/187
6,003,744 A * 12/1999 Culjak ..... 224/148.5
6,030,146 A * 2/2000 Nicolen et al. ..... 405/186
6,030,147 A * 2/2000 Bowden ..... 405/186
6,032,289 A * 3/2000 Villapiano ..... 2/102
6,120,213 A * 9/2000 Stinton ..... 405/186
6,227,199 B1 * 5/2001 Garofalo ..... 128/204.26

* cited by examiner 10
12
14
16
18
20
22
23
24
26
28
30
34
36
38
42
44
46
48
49
50
52
58
59
59a
62
64
70
70a
72
76
78
80
82

SUPPLIED AIR SNORKELING DEVICE

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE INVENTION

The present invention relates to snorkeling equipment. More specifically, the present invention relates to a supplied air snorkeling device. This device keeps the user floating on the surface of the water and includes apparatus for holding an air supply thereon.

Conventional snorkeling equipment includes a mouthpiece connected to a rigid breathing tube, which extends out of the water and into the air while the user's face is under the surface of the water. Conventional snorkeling equipment may also include goggles and a life preserver.

Modified snorkeling equipment also has been proposed. One type of modified snorkeling equipment includes a long, flexible air hose having one opening that is secured to a float on the surface of the water and another opening that is placed in a user's mouth. Such snorkeling equipment allows the user to snorkel at greater distances from the surface of the water than conventional snorkeling equipment. It is shown in U.S. Pat. No. 5,606,967.

Another type of modified snorkeling equipment is a toy scuba apparatus, as shown in U.S. Pat. No. 2,975,439. This apparatus includes a simulated air tank with a snorkel breathing conduit extending therethrough. The simulated air tank does not hold an air supply but merely functions as a buoyant float and a snorkeling device. A harness having straps attached thereto is laced to the flotation tank, and the straps are used to secure the flotation tank to a user's back. This apparatus further includes a mouthpiece and air conduit means secured to the flotation tank at one end and secured to a mouthpiece at the other end. This mouthpiece and air conduit function with the snorkel breathing conduit in the flotation tank as a snorkeling system.

One disadvantage of currently available snorkeling equipment is that a user is not necessarily kept on the surface of the water because a life preserver is not coupled with the breathing apparatus. In fact, some equipment even encourages the user to explore lower depths of the water. This can be dangerous for an inexperienced swimmer. Another disadvantage with conventional snorkeling equipment is that it is difficult to learn the breathing techniques necessary to use the mouthpiece and breathing tube of the snorkeling equipment.

In order to overcome these disadvantages, a device that keeps the user on the surface of the water is needed. Still further, this device should provide apparatus for holding a supply of air so that the user may be supplied air without learning snorkeling breathing techniques.

SUMMARY OF THE INVENTION

It is an object of the present invention to provide a device that keeps a person floating on the water while supplying contained air to the person when his face is in the water.

A further object of the present invention is to provide a flotation vest containing flotation material, that cannot be deflated and substantially prohibits a user from submerging, having a tank holder and a hose retainer coupled with the vest so that an air tank can be held on the vest and so that a mouthpiece coupled with a hose which is connected to the air tank may be kept in proximity to the user's face.

Another object of the present invention is to provide a flotation vest with a tank holder coupled with it and having a waist band and an adjustment strap so that the vest can be secured around a person in more than one way.

Still another object of the present invention is to provide a flotation vest coupled with an adjustable tank holder so that air tanks of various sizes can be carried on the back of the flotation vest.

Still another object of the present invention is to provide a flotation vest coupled with a tank holder that further includes a hose retainer coupled to the flotation vest so that a user is prohibited from descending any substantial distance below the surface of the water because the hose cannot be extended its entire length into the water and so that the user is discouraged against using the hose while being outside of the vest.

A further object of the present invention is to provide a method of making and a method of using a device for achieving the foregoing objects.

According to the present invention, the foregoing and other objects are achieved by a supplied air snorkeling device. This device includes a flotation vest coupled with a tank holder. This flotation vest contains flotation material that cannot be deflated and substantially prohibits a user from submerging. A tank cover is positioned within the tank holder for holding an air tank. Still further, a hose retainer is coupled with the vest. In use, an air tank is placed within the tank cover which is then placed within the tank holder. A hose extends from the air tank through the hose retainer and is coupled with a mouthpiece which fits into a user's mouth. The hose retainer keeps the mouthpiece near the user's mouth. Another aspect of the present invention is a method of making this supplied air snorkeling device. This method includes coupling a tank holder with a flotation vest. Still another aspect of the present invention is a method of snorkeling that includes securing this flotation vest coupled with a tank holder around a user and supplying contained air held by the tank holder to the user.

Additional objects, advantages and novel features of the invention will be set forth in part in the description which follows, and in part will become apparent to those skilled in the art upon examination of the following, or may be learned from practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 2:
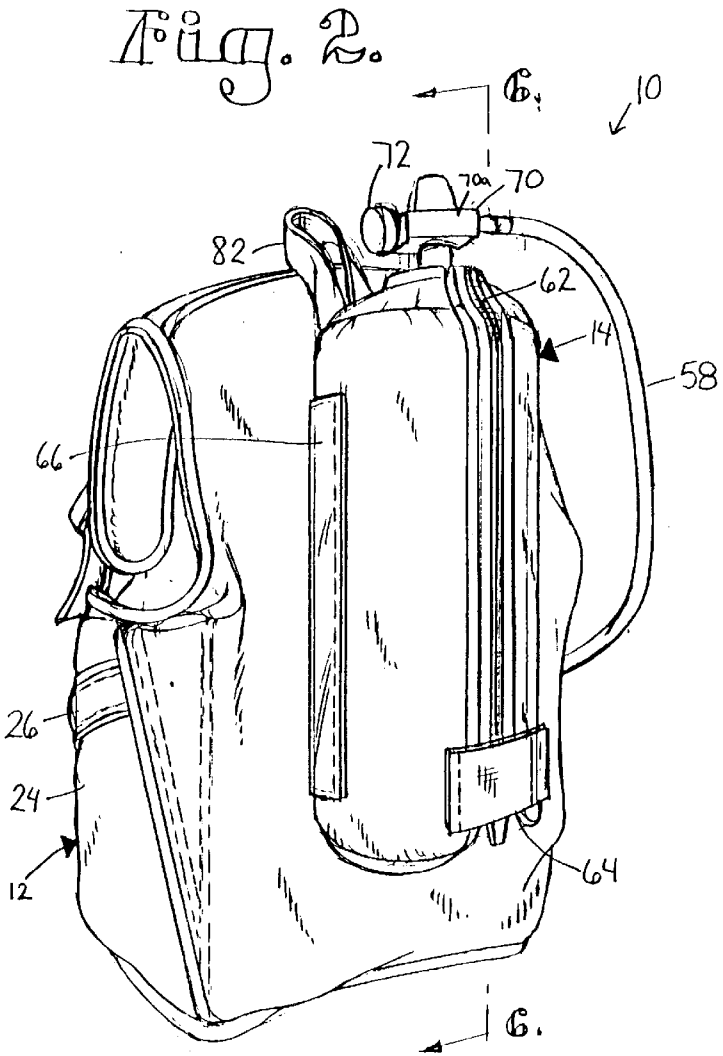
FIG. 2 is a back perspective view of the device of FIG. 1.
Figure 1:
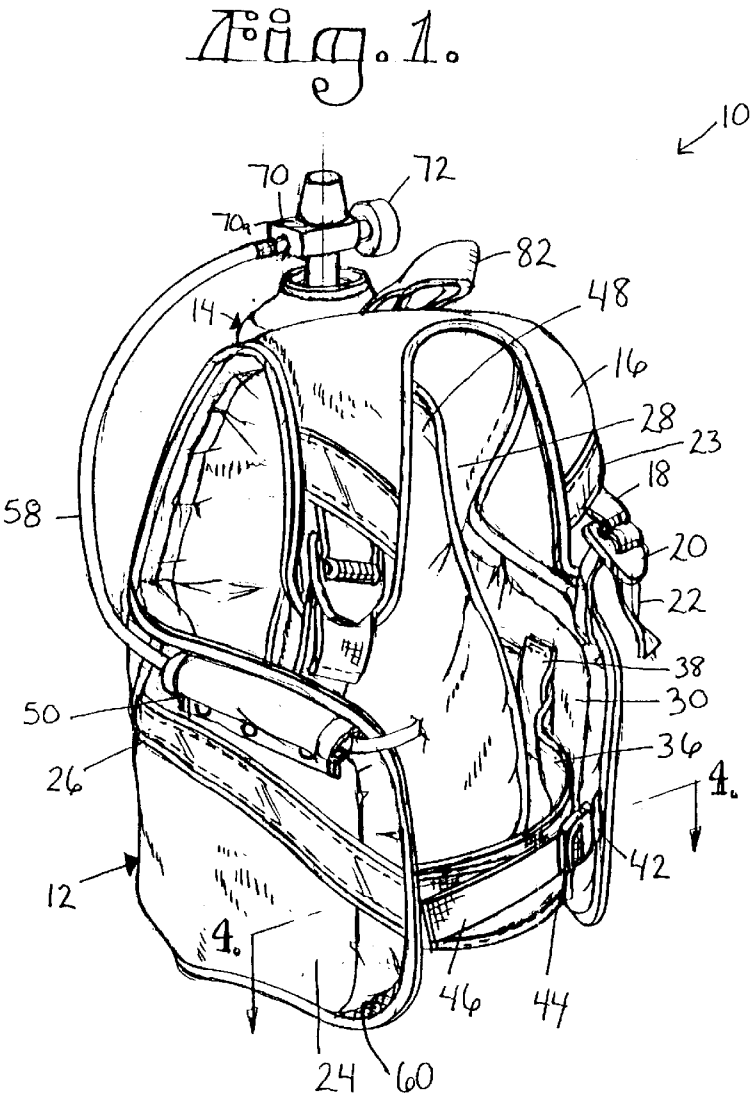
FIG. 1 is a front perspective view of a supplied air snorkeling device according to the present invention with the mouthpiece broken off.
Figures 5, 6, 7, 8:
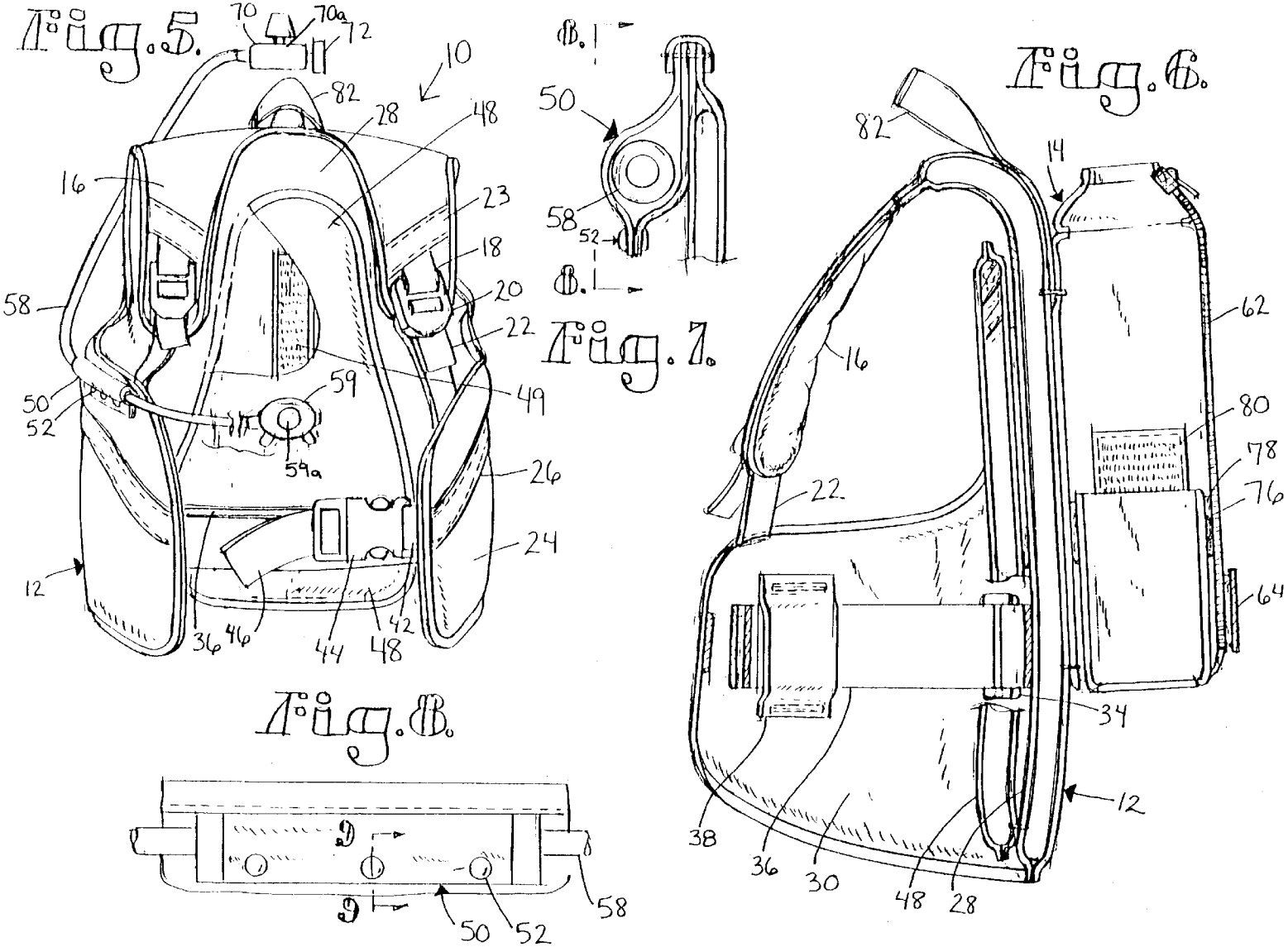
FIG. 5 is a front elevational view of the device of FIG. 1 without an air tank in the tank holder.
FIG. 6 is a vertical cross-sectional view of the supplied air snorkeling device taken generally along line 6—6 of FIG. 2.
FIG. 7 is a detached vertical cross-sectional view of a hose retainer, which is part of the supplied air snorkeling device of the present invention.
FIG. 8 is a front elevational view of the hose retainer taken in the direction of arrows 8—8 of FIG. 7.

A device embodying the principals of this invention is shown in FIGS. 1, 2, and 5 and is broadly designated by the reference numeral 10. Device 10 typically comprises a vest 12 coupled with a tank holder 14. Vest 12 has shoulder pads 16 that fit over the shoulders of the user, as shown in FIGS. 1 and 5. Straps 18 extend from shoulder pads 16 and are attached to adjustment buckles 20. Adjustment straps 22 are coupled with vest 12 and are threaded through adjustment buckles 20. Adjustment straps 22 can be pulled or released to either tighten or loosen shoulder pads 16 of vest 12. Reflective or decorative stripes 23 are coupled with shoulder pads 16. Vest 12 further includes side outer surfaces 24, as shown in FIGS. 1, 5, and 6. Reflective or decorative stripes 26 are coupled with side outer surfaces 24.

Figure 4:
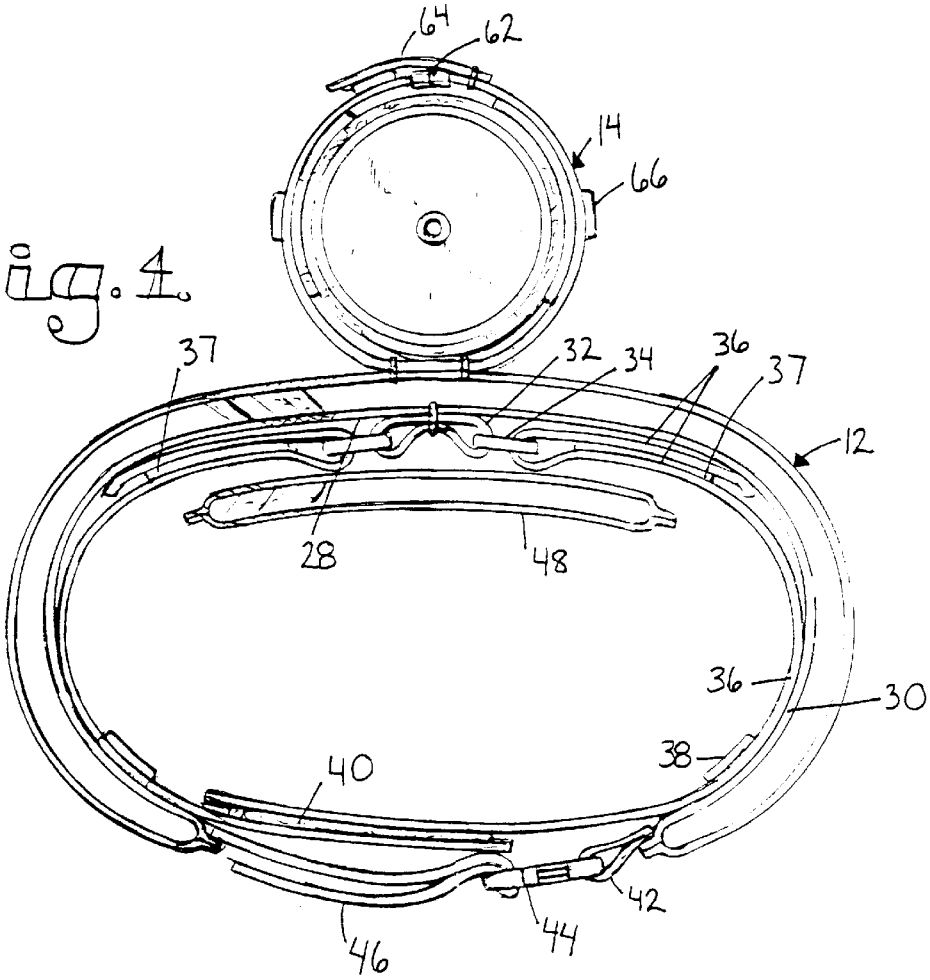
FIG. 4 is a horizontal cross-sectional view of the supplied air snorkeling device taken generally along line 4—4 of FIG. 1.

Vest 12 further includes a back inner surface 28, which is shown in FIGS. 1, 4, 5, and 6, and side inner surfaces 30, which are shown in FIGS. 1, 4, and 6. Looped strap 32 is coupled with back inner surface 28 of vest 12, and links 34 are coupled with looped strap 32. Waist band 36 is also coupled with links 34 at each of its ends. Preferably, it is coupled with a hook and a loop fastening system 37. Waist band 36 extends around back inner surface 28 to side inner surfaces 30 of vest 12. Waist band guides 38 are coupled with the side inner surfaces 30 of vest 12 and waist band 36 is threaded through waist band guides 38. Waist band 36 is fastened around a user's stomach with a hook and loop fastening system 40. Strap 42 is coupled with one of the side inner surfaces 30 of vest 12 at one end and is coupled with closure buckle 44 at its other end. Adjustment strap 46 is coupled to the other side inner surface of vest 12 at one end and is threaded through closure buckle 44 at its other end. Waist band 36, strap 42, closure buckle 44, and adjustment strap 46 are shown best in FIGS. 1, 4 and 5. Flotation cushion 48 is coupled with back inner surface 28 of vest 12, as shown in FIGS. 1, 4, and 5. Preferably, it is coupled to back inner surface 28 with a hook and loop fastening system 49, as shown in FIG. 5.

Figure 9:
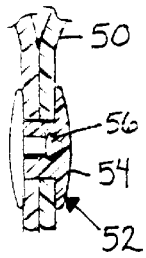
FIG. 9 is an enlarged cross-sectional view of a clasp on the hose retainer taken generally along line 9—9 of FIG. 8.

A hose retainer 50 is coupled with one of the side outer surfaces 24 of vest 12, as shown in FIGS. 1 and 5. Preferably, it is attached to the right side outer surface 24. Hose retainer 50, which is shown in more detail in FIGS. 7 and 8, includes clasps 52 which allow hose retainer 50 to be closed and opened only if proper tools are used. Clasp 52 is shown in more detail in FIG. 9. It includes a socket 54 and a pin 56, which is received by socket 54. Clasp 52 may be a rivet or other type of clasp that creates a permanent closure when pin 56 is pushed against socket 54. In order to open clasp 52, wire cutters, a serrated knife or other tools must be used. Hose 58, to which regulator 59*a* and mouthpiece 59 are coupled thereto, may be threaded through hose retainer 50 before regulator 59*a* is attached to its end, or hose 58 may be placed within hose retainer 50 before it is clasped together by clasps 52. Vest 12 further has a lower edge which defines a water drainage slot 60, as shown in FIG. 1. Flotation cushion 48 may also define a water drainage slot (not shown) at its lower edge.

Figure 3:
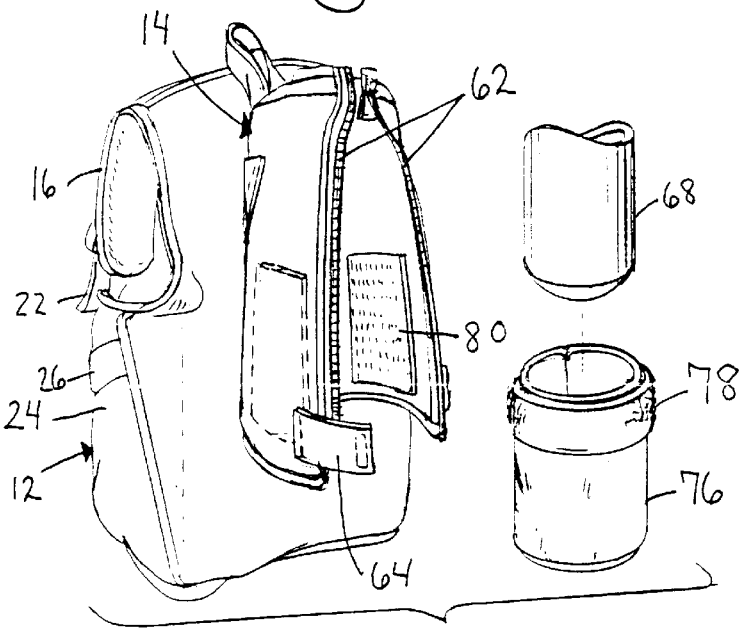
FIG. 3 is an exploded back perspective view of the supplied air snorkeling device of FIG. 1.

Referring to tank holder 14, which is best shown in FIGS. 2, 3, 4, and 6, it includes a zipper 62 and a zipper slide retainer 64 coupled thereto. Zipper slide retainer 64 is placed over zipper 62 when it is in a closed position so as to keep it from opening. Tank holder 14 further includes reflective or decorative stripes 66 thereon, as shown in FIGS. 2 and 4. As shown in FIG. 2, air tank 68 is coupled with valve 70. Screw 72 and hose 58 are also coupled with valve 70. Preferably, hose 58 screws into valve 70. Air tank 68 fits within tank cover 76, as shown in FIG. 3. Tank cover 76 includes fastening band 78 around its circumference. Tank holder 14 has an inner surface that includes a tank holder retainer 80 attached thereto. Tank cover 76 is placed within tank holder 14 and fastening band 78 is coupled with tank holder retainer 80. Preferably, tank cover 76 is coupled with tank holder 14 by a hook and loop fastening system. Still further, a lift handle 82 is coupled between vest 12 and tank holder 14, as shown in FIGS. 1–3, 5, and 6.

A two stage regulator is used in conjunction with the air supply system to regulate air being supplied to a user. Specifically, a first stage regulator 70*a* is coupled with valve 70 of air tank 68, hose 58 runs from first stage regulator 70*a* to a second stage regulator 59*a*, which is coupled with mouthpiece 59. First stage regulator 70*a* reduces the pressure of the air exiting air tank 68 before it is fed into hose 58. Second stage regulator 59*a* further reduces the pressure of the air and releases air to a user upon demand. The use of a regulator in the supplied air snorkeling device of the present invention further distinguishes it from conventional snorkeling equipment.

The supplied air snorkeling device of the present invention is made by coupling tank holder 14 with flotation vest 12. Straps 18 and adjustment straps 22 are attached to vest 12 at one end and are coupled with buckles 20 at the other end. Hose retainer 50 is attached to a side outer surface 24 of vest 12. Tank cover 76 is releasably coupled with tank holder 14. Specifically, fastening band 78, which is around the circumference of tank cover 76, is received by tank holder retainer 80, which is attached to the inner surface of tank holder 14. Preferably, tank holder retainer 80 extends at least half the length of tank holder 14, allowing tank cover 76 to be coupled with the inner surface of tank holder 14 at numerous positions, as shown in FIG. 3. This creates an adjustable tank holder for holding tanks of various sizes. Flotation cushion 48 and waist band 36 are coupled with vest 12. Preferably, a hook and loop fastening system is attached to waist band 36 for securing it around a user's waist. Preferably a hook and loop fastening system is attached to flotation cushion 48 and vest 12 for coupling these pieces together. Still further, adjustment strap 46 and strap 42 are connected to vest 12 at one end and closure buckle 44 at their other ends.

In use, air tank 68 is placed within tank cover 76. Tank cover 76, which is holding air tank 68, is then placed within tank holder 14. Tank holder 14 is zipped closed with zipper 62 and zipper slide retainer 64 is secured across zipper 62. Clasps 52 on hose retainer 50 of flotation vest 12 are in open positions so that hose 58 with regulator 59*a* attached may be placed in hose retainer 50. Clasps 52 are then fastened. A user then puts on the vest by putting his arms through the arm holes defined by shoulder pads 16, straps 18, adjustment straps 22, and side outer surfaces 24. Waist band 36 is then fastened approximately around the user's waist. Closure buckle 44, which overlays waist band 36, is then also fastened. Adjustment strap 46 may be pulled or released so as to adjust the size of the vest. Still further, adjustment straps 22 may be pulled or released so as to adjust the upper size of flotation vest 12. Mouthpiece 59, which is attached to regulator 59*a*, is placed in user's mouth. Valve 70 on air tank 68 is adjusted so that a controlled amount of air is supplied to the user.

Second stage regulator 59*a* cannot be removed from hose 58 without using some type of tool. Usually, a wrench is used to remove regulator 59*a*. Still further, as discussed previously, clasps 52 on hose retainer 50 create a permanent closure when pin 56 is pushed against socket 54. Tools such as wire cutters or a serrated knife must be used to essentially cut or saw through the clasps 52. Hose 58, to which regulator 59*a* is attached, may be threaded through hose retainer 50 before regulator 59*a* is attached to its end, or hose 58 may be placed within hose retainer 50 before it is clasped together by clasps 52. Once hose 58 is held within hose retainer 50, clasps 52 are closed, and regulator 59*a* is coupled with hose 58, hose 58 is maintained within hose retainer 50. It will not slide through hose retainer 50 because regulator 59*a* is wider than the diameter of hose retainer 50. Furthermore, because tools are required for disassembly of these pieces of equipment, this discourages separation by a user while the device is in use.

One advantage of maintaining hose 58 in hose retainer 50 is that the regulator end of hose 58, to which regulator 59*a* and mouthpiece 59 are coupled thereto, is kept in close proximity to a user's face. Another advantage of maintaining hose 58 in hose retainer 50 is that hose 58 is prevented from being substantially extended into a body of water. More specifically, hose retainer 50 interlocks around hose 58 so as to prevent the entire length of hose 58 from being extended from said vest 12. In addition, hose retainer 50 helps to discourage or generally prohibit a user from removing hose 58 so as to use it while being outside of the vest because only a short amount of hose 58 can extend from vest 12.

Flotation vest 12 contains flotation material that cannot be deflated and substantially prohibits a user from submerging. Preferably, flotation vest 12 includes flotation material which is covered by a sonic-welded jacket. The flotation material in vest 12 is not deflatable. Still further, preferably, hose 58 has a smooth outer surface, allowing it to slide easily within hose retainer 50 when a user's head moves thus moving hose 58. Preferably, stripes 23, 26, and 66 are made of a reflective material. Preferably, clasp 52 is made of a hard plastic material.

This supplied air snorkeling device may be used to explore the surface of the water without learning the breathing techniques of snorkeling. This device may be used with a standard mask or goggles. It may be used as a training device for those who are not certified in scuba but who would like to eventually learn to scuba dive and how to breath contained air through a mouthpiece. This device is especially useful for children that are too young to be certified in scuba or for all people that are inexperienced swimmers.

From the foregoing, it will be seen that this invention is one well adapted to attain all the ends and objects hereinabove set forth together with other advantages which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

I claim:

1. A supplied air snorkeling device for providing buoyancy and supplying air to a snorkeler swimming on a surface of a body of water, comprising:

a flotation vest having a front side that, during use, rests against the snorkeler's chest, and a back side that, during use, rests against the snorkeler's back, said vest including buoyant material providing sufficient buoyancy to hold in a snorkeling position on the surface of the water, both the snorkeler and a compressed air tank of the type utilized for underwater scuba diving;

a compressed air tank of the type utilized for underwater scuba diving, said tank having an opening at one end and an exposed air valve that controls the flow of air from the tank, said valve being readily accessible for adjusting the flow of air from the tank;

a tank holder that holds the compressed air tank, said tank holder being longitudinally mounted on a centerline of the back side of the vest, and said tank holder including means for facilitating rapidly releasing an empty air tank and rapidly mounting a full air tank within the tank holder, said facilitating means including:

a zipper for opening and closing the tank holder;

a zipper slide retainer for maintaining the zipper in a closed position; and a tank cover positioned within the tank holder for holding the tank, wherein the tank cover includes a fastening band, and the tank holder includes a tank holder retainer that extends for at least about half the length of the tank holder, wherein the fastening band can be coupled with the tank holder retainer at various locations along the tank holder retainer for holding various sized tanks; and an air hose connected at a first end to the air valve, said air hose carrying air from the compressed air tank to a mouthpiece mounted at a second end of the hose.

2. The device of claim 1, wherein the flotation vest includes a lower a edge which defines slot for draining water.

3. The device of claim 2, wherein the flotation vest includes shoulder pads.

* * * * *